US007304025B2

(12) United States Patent
Hardy et al.

(10) Patent No.: US 7,304,025 B2
(45) Date of Patent: Dec. 4, 2007

(54) DETERGENT PACK

(75) Inventors: Gillian Margaret Hardy, Newcastle upon Tyne (GB); Mark Timothy Haward, Newcastle upon Tyne (GB); Manuel Mariani, Pescara (IT)

(73) Assignee: The Procter & Gamble Company, Cincinnati, OH (US)

( * ) Notice: Subject to any disclaimer, the term of this patent is extended or adjusted under 35 U.S.C. 154(b) by 129 days.

(21) Appl. No.: 11/147,010

(22) Filed: Jun. 7, 2005

(65) Prior Publication Data

US 2005/0272624 A1 Dec. 8, 2005

(30) Foreign Application Priority Data

Jun. 8, 2004 (EP) ..... 04253406

(51) Int. Cl.
*C11D 3/50* (2006.01)

(52) U.S. Cl. ..... 510/439; 510/105

(58) Field of Classification Search ..... 523/102; 512/2, 4; 510/105, 439
See application file for complete search history.

(56) References Cited

U.S. PATENT DOCUMENTS

2003/0105183 A1* 6/2003 Sharak ..... 523/102

FOREIGN PATENT DOCUMENTS

| | | | |
|---|---|---|---|
| WO | WO 02/20361 | * | 3/2002 |
| WO | WO 02/42401 | * | 5/2002 |
| WO | WO 03/047998 | * | 6/2003 |

* cited by examiner

*Primary Examiner*—John R. Hardee
(74) *Attorney, Agent, or Firm*—Jeffrey V. Bamber; Laura R. Grunzinger

(57) ABSTRACT

Detergent pack comprising a combination of a malodour-generating water-soluble cleaning pouch, comprising a liquid composition and an enveloping film material, and a packaging container therefor wherein:

a) the liquid composition comprises a first perfume; and
b) the packaging container comprises a hot melt adhesive adhered to an internal wall thereof, the hot melt comprising an aldehyde-comprising perfume.

There is also provided a method of preventing or reducing malodour in the interior of a packaging container containing a malodour-generating water-soluble pouch.

4 Claims, No Drawings

DETERGENT PACK

TECHNICAL FIELD

The present invention is in the field of detergent packs. In particular it relates to detergent packs comprising a combination of a packaging container and a water-soluble cleaning pouch. The invention also relates to a method of preventing or reducing malodour in the interior of a packaging container containing a water-soluble pouch.

BACKGROUND OF THE INVENTION

Cleaning detergent compositions are usually perfumed. Powdered cleaning products usually include perfume sprayed onto the powder. Liquid cleaning products usually include perfume dissolved/emulsified therein. In traditional products, part of the perfume is released from the composition into the headspace of the package providing a pleasant smell each time that the package is opened or at least for the first few times. Consumers associate the pleasant smell with cleaning capacity and expect to perceive perfume each time that the package is opened.

Water-soluble cleaning pouches, i.e. cleaning compositions enveloped with a water-soluble film which dissolves in use, may contain perfume. Most water-soluble film materials, such as polyvinyl alcohol films are substantially perfume-impermeable precluding or reducing the transfer of perfume from the interior of the pouch to the packaging container.

Usually the water-soluble film material is vulnerable to moisture. In order to protect the film and the enclosed composition the pouches are stored in packaging containers which reduce transfer of moisture from the environment to the interior of the pouch and vice-versa. WO 03/047998 discloses the combination of a water-soluble capsule containing a detergent composition with a package containing the capsule. The package is formed from a material which has a moisture vapour transfer rate of between 0.25 g/m2/day to 10 g/m2/day at 38° C. and 90% relative humidity.

It has now been found that water-soluble cleaning pouches may generate malodours, mainly proceeding from film material impurities derived from the manufacturing process. These malodours accumulate in the confined headspace of the package, and are easily perceived when opening the package. This is the first moment of interaction between the consumer and the product. The acceptance of the product is to a great extent based on this moment. Consumers find these malodours very unpleasant and associate them with harsh chemicals. This can adversely impact on consumer acceptance.

Malodours could be masked with strong or high levels of perfume, however, the use of strong perfumes in cleaning product is not well accepted by consumers, especially in the case of automatic dishwashing compositions. Consumers again associate the strong smell with harsh chemicals and do not like to use highly perfumed products on items which are going to be in contact with food. Acceptable perfumes for use in dishwashing products need to have a freshness connotation.

SUMMARY OF THE INVENTION

According to a first aspect of the invention there is provided a detergent pack comprising a combination of a malodour-generating water-soluble cleaning pouch and a packaging container therefore. The pouch preferably comprises a liquid composition which in preferred embodiments comprises a perfume. The packaging container comprises a hot melt adhesive adhered to an internal wall thereof, the hot melt comprising a second perfume which may be the same or different to the first perfume. The second perfume is effective in counteracting the malodour of the cleaning pouch and in preferred embodiments is an aldehyde-containing perfume.

The pack preferably contains at least 10 pouches and more preferably at least 12 pouches. In a preferred embodiment the enveloping film material is polyvinyl alcohol. The first time and each subsequent time that the packaging container is opened a very pleasant smell is obtained.

By "hot melt adhesive" is understood a polymeric composition which has been melted, delivered and adhered to the packaging container on cooling. The composition is adhesive per se and does not require adhesive aids in order to adhere to the packaging container. Preferably the melting temperature of the adhesive is below the flash point of the aldehyde-comprising perfume, preferably below 100° C. and more preferably below 70° C.

It has now been found that there is a malodour, resembling a "fishy" smell, associated with pouches especially when they are packaged in a confined space. It is believed that the enveloping film material, especially when the material is polyvinyl alcohol, is mainly responsible for this malodour. The invention is therefore of particular application to detergent pouches wherein the enveloping film material is itself malodour generating. Without being bound by theory, it is believed that the malodour may be caused by amines or other impurities trapped into the film during the manufacturing process. The amines and/or other impurities are gradually released during the life of the pouch generating malodours. The malodours are especially noticeable if restricted to a confined space with small volume, for example, the malodour is easily detectable in a PET/PE laminate packaging container of the following dimensions: 8.9 cm gusset, 15.9 cm width and 18.1 cm height, comprising 12 pouches of about 20 ml volume each. It is theorised that the amines may react with the aldehydes released form the perfume creating a complex which is olfactory pleasant. The pleasant smell is obtained not only the first time but each time that the packaging container is opened (it is expected that the packaging container will be opened as many time as the number of pouches contained, i.e., about 12 times). The hot melt adhesive is capable of providing sustained release of the perfume, allowing for the replenishment of the headspace after each time that the packaging container has been opened and subsequently closed.

By cleaning pouch is understood a cleaning composition, i.e., detergent or additive composition, for use in cleaning—including laundry, manual and automatic dishwashing, etc—packed within a water-soluble film which dissolves in use, i.e., the film does not need to be removed for use of the cleaning composition. The term "pouch" as used herein includes sachets, capsules and wrapped portions. A pouch has usually a volume of from about 40 to about 10 ml, preferably from about 30 to about 20 ml. The dimensions may vary depending on the geometry of the pouch, rectangular, square pouches may have a foot print of from about 6×6 $cm^2$ to about 2×2 $cm^2$, preferably from about 4×4 $cm^2$ to about 2.5×2.5 $cm^2$ and a height of from about 0.5 to about 2 cm, preferably from about 0.8 to about 1.8 cm. Oval, elliptic and round pouches may have a maximum diameter ranging from about 2 to 6 cm and a height of from about 0.5 to about 2 cm.

In a preferred embodiment the hot melt comprises, by weight thereof:

a) a copolymer of ethylene with at least another monomer comprising at least a heteroatom;

b) at least 10% of a plasticizer comprising at least one heteroatom; and c) from about 20% to about 70%, preferably from about 30% to about 60% of aldehyde comprising-perfume.

The hot melt provide a uniform and sustained release of the perfume, permitting the replenishment of the headspace after each time that a pouch is dispensed.

The cleaning pouch can be a single or multi-compartment pouch. In the case of a multi-compartment pouch the liquid composition can be either a cleaning composition (i.e., containing cleaning actives such as builders, etc) or purely an aesthetic composition containing perfumes, dyes, etc.

The term 'liquid' as used herein also includes gels, pastes, and liquid compositions with solid suspended therein. The liquid composition comprises a first perfume. The first perfume and the aldehyde-comprising perfume can be the same, but preferably they are different. The film material is usually substantially impermeable to perfume. The perfume contained in the liquid composition will mainly be released in use. No or negligible perfume benefits would be derived from the liquid composition during storage and handling. The pack of the invention provides a pleasant smell when the packaging container is opened, as well as when the pouch is used. This execution permits the delivery of two similar or different perfumes, one during handling and one during use, providing a more complete and pleasant olfactory experience for the consumer. Usually the perfume experience expected during the handling and dispensing of the pouch is different to that expected in use, different perfume characters and intensity are required. The present execution allows for optimization at the two moments, without needing a compromise. The present execution also allows the perfume of the liquid composition to remain intact until the composition is released in use.

In a preferred multi-compartment embodiment, the pouch comprises a powder composition which may additionally comprise a perfume. Pouches containing gas generating ingredients, as for example, bleach, may have a gas release means, for example a pin hole, to release gases formed during storage. The gas release means could also release a small amount of perfume and/or malodour. For certain applications, such as automatic dishwashing a high level of perfume is not acceptable. Consumers do not like to have their tableware in contact with high levels of perfume. Although pouches having gas release means could release some perfume the amount released does not seem to be sufficient to overcome the malodour problem resulting from the film. If the level of perfume in the powder composition were increased this would generate an overpowering effect when in use and leave a residual smell on the tableware, which may not be acceptable. The perfume released from the hot melt adhesive may also counteract malodours coming from the powder composition through the pin hole.

In another preferred embodiment the packaging container is a reclosable flexible bag, preferably self-standing and preferably having a non-return valve. This allows the pumping out of perfume, by simply squeezing the bag, each time that the bag is held, even before it is opened.

The bag has two rectangular side walls which are heat (or glue)—sealed together along corresponding longitudinal edges and which are closed at one end by a base wall and at the other end by seals. The base wall is formed from a rectangular sheet of plastic, perimeter portions of which are heat (or glue)—sealed to respective edge portions of the end portions of the side walls. The sealing portion (i.e. the part forming the seal with the base wall) is shaped such that the effective base area is very generally elliptical.

By "flexible" bag is understood a bag which can be easily deformed with a hand squeeze, preferably deformed by the mere act of holding the bag.

According to another aspect of the present invention there is provided a method of preventing or reducing malodour in the interior of a packaging container containing a malodour-generating water-soluble pouch, comprising a cleaning composition and an enveloping film material, by providing the packaging container with a hot melt adhesive adhered to an internal wall thereof, the hot melt adhesive comprising an aldehyde-comprising perfume.

In a preferred embodiment the enveloping film material is polyvinyl alcohol. The method is suitable for packaging containers containing any type of malodour generating pouches. Although it is believed that the malodour is mainly due to the film material, this method seems to be capable of coping with other malodours which may be coming from the cleaning composition. In a preferred embodiment, the method of the invention is performed on a detergent pack containing dual compartment pouches, having a powder compartment and liquid compartment.

DETAILED DESCRIPTION OF THE INVENTION

The present invention envisages a detergent pack comprising a packaging container for containing and dispensing a water-soluble cleaning pouch. The packaging container has a perfume-comprising hot melt adhesive adhered to an interior wall. The hot melt slowly releases perfume, providing a pleasant smell each time that the packaging container is opened. Preferred embodiments provide a pleasant smell each time that the pack is handled (even before it is opened). The cleaning composition also comprises perfume that is released in use. The present invention also envisages a method of preventing or reducing malodour in the interior of a packaging container containing pouches by providing the packaging container with a hot melt adhesive comprising an aldehyde-comprising perfume.

Water-soluble cleaning pouches are well known in the art. For example WO 02/42400, WO 02/42401 WO 02/16541 and WO 02/16222 describe water-soluble cleaning pouches.

Suitable pouch materials for use herein are described in page 22, line 20 to page 24 line 8 of WO 02/42408.

Preferred pouch materials include PVA (polyvinyl alcohol) films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

Packaging Container

The packaging container can be a tub, tray, jar, bottle, bag, box, ete, preferably the packaging container is reclosable and preferably has a moisture vapour transfer rate of less than 0.25 g/m2/day at 38° C. and 90% relative humidity. Suitable packaging containers for use herein include those described in WO 02/20361. Optionally, but preferably, the container closure will have child resistant features as well as a window or other means for viewing the contents of the package when the closure is in a closed position. A specially preferred packaging container is a self-standing flexible bag as described in WO 03/047998 page 4, lines 6 to 26 and FIG. 1, preferably with a non-return valve.

Any non-return valve can be used herein, however for the sake of simplicity a small cut in the packaging container is preferred, creating a very small slot or orifice—from about 0.1 to about 3, preferably from about 0.5 to about 1.5 mm diameter—but without removing the material corresponding to the cut.

First Perfume Composition

The level of perfume in the liquid composition may range from about 0.001 to about 10%, preferably from about 0.05 to about 5% and more preferably from about 0.01 to about 1.5% by weight of the liquid composition. Preferred perfumes for use herein, especially for use in automatic dishwashing executions, are perfume which do not leave residual odor on the cleaned surfaces. Preferred perfumes for use in automatic dishwashing pouches are blooming perfumes as described in WO 97/34987.

Aldehyde-Comprising Perfumes

Suitable aldehydes for use herein are those traditionally used in perfumes and can be found in "Perfume and Flavor Chemicals", Vol. I and II, S. Arctander, Allured Publishing, 1994, ISBN 0-931710-35-5. Suitable aldehydes include C6-C14 aliphatic aldehydes, C6-C14 acyclic terpene aldehyde and mixtures thereof. Preferably, the perfume component of the present invention is selected from C8-C12 aliphatic aldehydes, C8-C12 acyclic terpene aldehydes and mixtures thereof. Most preferably, the perfume component of the present invention is selected from the group consisting of citral; neral; iso-citral; dihydro citral; citronellal; octanal; nonanal; decanal; undecanal; dodecanal; tridecanal; 2-methyl decanal; methyl nonyl acetaldehyde; 2-nonen al; decanal; undecenal; undecylenic aldehyde; 2,6 dimethyl octanal; 2,6,3,10, trimethyl undecen-1-al; trimethyl undecanal; dodecenal; melonal; 2-methyl octanal; 3,5,5, trimethyl hexanal and mixtures thereof. Preferably, the perfumes for use in the hot melt comprise at least 1% of aldehydes, more preferably at least 2% and especially at least 4% by weight of the perfume composition.

Preferably, the perfume included in the hot melt adhesive has a citrus character, i.e., a smell having a resemblance to lemon, orange, lime, grapefruit, etc. Citrus perfumes are associated with freshness and cleanness and are the preferred perfumes to use in some cleaning products, as for example dishwashing detergents.

Hot Melt Adhesive

The amount of hot melt adhesive placed on the interior of the packaging container depends on the size, specially the amount of headspace, thereof and the number and size of pouches contained therein. For example, a packaging container containing 12 polyvinyl alcohol pouches of a volume of about 20 ml wherein the pouches occupy more than 40%, preferably more than 60% and more preferably more than 70% of the interior volume of the packaging container, would require from about 0.05 to about 0.3 grams of hot melt adhesive-the hot melt comprising between 40% to 60% of aldehyde comprising-perfume-preferably from about 0.1 to about 0.2 grams.

The first essential component of the preferred hot melt adhesive for use herein is a copolymer of ethylene with at least another monomer comprising at least a heteroatom. All copolymers of ethylene with at least another monomer comprising at least a heteroatom are suitable for use herein.

The term "monomer comprising at least a heteroatom" includes all those monomers which comprise at least a C—X linkage wherein X is not C or H. Said C—X linkage is preferably a polar linkage. Preferably the carbon atom is linked to an N, S, F, Cl or O atom. More preferably said polar linkage is part of a carbonyl group and, more preferably, of an ester group. Preferred monomers comprising at least a heteroatom for the present invention are vinyl acetate, vinyl alcohol, methyl acrylate, ethyl acrylate, butyl acrylate, acrylic acid and salts formed therefrom, methacrylic acid and salts formed therefrom, maleic anhydride, glycidyl methacrylate and carbon monoxide.

Suitable copolymers for use herein can be both block and non-block copolymers, grafted copolymers, copolymers with side chains, or crosslinked and copolymers where ethylene monomers are randomly copolymerized with monomers comprising at least a heteroatom.

Preferred copolymers of ethylene include ethylene-vinyl ester copolymers, ethylene-acrylic ester copolymers, ethylene-methacrylic ester copolymers, ionomers, ethylene-acrylic acid copolymers, ethylene-methacrylic acid copolymers, ethylene-vinyl ester-acrylic acid copolymers, ethylene-vinyl ester-methacrylic acid copolymers, ethylene-vinyl ester-maleic anhydride copolymers, ethylene-acrylic ester-maleic anhydride copolymers, ethylene-vinyl ester-glycidyl methacrylate copolymers, ethylene-acrylic ester-glycidyl methacrylate copolymers, ethylene-maleic anhydride copolymers, ethylene-glycidyl methacrylate copolymers The monomer comprising at least a heteroatom in the copolymers suitable for the present invention represents from 10% to 90% of the total weight of the copolymer, preferably at least 14% more preferably at least 18%.

Particularly preferred copolymers include ethylene-vinyl acetate copolymers such as those sold under the trade names Elvax™ by Dupont, Evathanem by Atofina, Escorene™ by Exxon and Levapren™ and Levamelt™ by Bayer and ethylene-acrylic ester copolymers such as those sold under the trade name Lotryl™ by Atofina.

The second essential component of the preferred hot melt adhesive for use herein is a plasticizer or mixture of plasticizers comprising at least one heteroatom, compatible with the copolymer of ethylene with at least another monomer comprising at least a heteroatom. The term "plasticizer comprising at least a heteroatom" includes all those plasticizers which comprise at least a C—X linkage in the molecule wherein X is not C or H. Said C—X linkage is preferably a polar linkage. Preferably the carbon atom is linked to an N, S, F, Cl or O atom. More preferably said polar linkage is part of a carbonyl group and, more preferably, of an ester group.

Suitable plasticizers for use herein include citric acid esters, low molecular weight polyesters, polyethers, liquid rosin esters, aromatic sulfonamides, phthalates, benzoates, sucrose esters, derivatives of polyfunctional alcohols (where polyfunctional means having 2 or more hydroxyl groups), adipates, tartrates, sebacates, esters of phosphoric acid, fatty acids and diacids, fatty alcohols and diols, epoxidized vegetable oils etc and mixtyres thereof. As already mentioned above, the different polarity of the different compatible plasticisers (measurable with any method known to those skilled in the art, for example water/octanol partition coefficient) can be used to tune the polarity of the polymeric matrix in order to provide a better match with the polarity of the volatile material.

Preferably the hot melt adhesive composition comprises from 5% to 75%, more preferably from 10% to 50% by weight of the composition, of the copolymer of ethylene with at least another monomer comprising at least a heteroatom; from 10% to 60%, preferably from 15% to 40% by weight of the composition, of the compatible plasticizer or blend of plasticizers comprising at least one heteroatom, and more than 20%, preferably more than 30%, more preferably more than 40% of a perfume; the volatile material is preferably comprised up to a maximum percentage of 80% by weight of the composition.

The polymeric hot melt adhesive may, in addition, comprise additional optional components to further improve the processability of the compositions and also the mechanical characteristics as well as other characteristics as tackiness, resistance to ageing by light, oxygen and heat, visual appearance etc., of the objects formed from such polymeric compositions.

Such optional components may include other copolymers that can be included in the formulations to improve their properties for example to increase adhesion or compatibility with substrates. To this purpose preferred optional copolymers are copolymers of styrene and at least one other vinyl or acrylic monomer, copolymers of poly(vinyl alcohol), polyamides, polyether amide copolymers, polyester amide copolymers, polyesters, polyether ester copolymers, polyurethanes, polyethers, poly(2-ethyl-2-oxazoline), copolymers of poly(vinyl pyrrolidone), polyacrylates, copolymers of polyvinyl ethers), etc.

The techniques for obtaining aqueous emulsions or dispersions of polymers are well known to the skilled man. For example, the selected polymer, plasticiser and perfume can be blended together as a thermoplastic material. The resulting melt can then be dispersed in water, preferably at a temperature above its melting point, by mixing. Surfactant and/or stabilizing systems known to those skilled in the art can be employed to stabilize the resultant emulsion or dispersion.

Alternatively, a preformed aqueous polymeric dispersion or emulsion can be blended with the selected plasticiser and perfume. This can be done by adding the ingredients directly to the polymeric dispersion or emulsion, or e.g. by forming an aqueous dispersion of the perfume and plasticiser and blending this with the polymeric dispersion or emulsion. Both procedures result in the formation of an aqueous dispersion of a polymeric composition according to the present invention.

Alternatively, the polymeric dispersion can be formed in the presence of the plasticiser and/or of the perfume. This process can involve the solution or dispersion of monomers or prepolymers in water containing the dispersed volatile material and/or plasticiser. The polymerization can then be initiated to form the polymeric dispersion. If required, the perfume or plasticiser can be added subsequently to produce a dispersed polymeric composition.

The preferred hot melt adhesive compositions for use herein, due to their rheology and to their adhesion properties, are particularly useful to be applied in the molten state onto a selected substrate, and directly adhered thereto. For example they can be readily applied to the inner surface of a container. Such application can be easily achieved during the manufacturing of the container. The polymeric composition can be applied by means of a conventional hot melt delivery system. This system typically includes a melting unit, which maintains the hot melt at the temperature required to have a processable viscosity. The melting unit typically contains a pumping system capable of pumping the hot melt through a length of hose until it reaches the glue gun, or nozzle. The nozzle can have different geometries according to the desired application form of the glue (coatings, stripes, beads etc). In a typical embodiment, a slot nozzle can be used as the glue gun.

All the documents mentioned herein are incorporated by reference.

EXAMPLES

Abbreviations used in Examples

In the examples, the abbreviated component identifications have the following meanings:

Carbonate: Anhydrous sodium carbonate

STPP: Sodium tripolyphosphate

Silicate: Amorphous Sodium Silicate ($SiO_2$:$Na_2O$=from 2:1 to 4:1)

HEDP: Ethane 1-hydroxy-1,1-diphosphonic acid

Percarbonate: Sodium percarbonate of the nominal formula $2Na_2CO_3.3H_2O_2$

Carbonate: Anhydrous sodium carbonate

Termamyl: α-amylase available from Novo Nordisk A/S

FN3: protease available from Genencor

SLF18: Poly-Tergent® available from BASF $C_{14}$AO: tetradecyl dimethyl amine oxide DPG: dipropylene glycol In the following examples all levels are quoted as percent (%) by weight.

Pouch

The compositions A and B (Table 1) are introduced into two compartment layered PVA rectangular base pouches. The dual compartment pouches are made from a Monosol M8630 film as supplied by Chris-Craft Industrial Products. 17.2 g of the particulate composition and 4 g of the liquid composition are placed in the two different compartments of the pouch. The pouch dimensions under 2 Kg load are: length 3.7 cm, width 3.4 cm and height 1.5 cm. The longitudinal/transverse aspect ratio is thus 1.5:3.2 or 1:2.47.

TABLE 1

| pouch composition | A | B |
|---|---|---|
| Particulate composition | | |
| STPP | 60 | 60 |
| HEDP | 1 | 1 |
| Termamyl | 1.5 | 1.5 |
| FN3 | 2 | 2 |
| Percarbonate | 17 | 17 |
| Carbonate | 11 | 11 |
| Silicate | 7 | 7 |
| Perfume | 0.5 | 0.5 |
| Liquid composition | | |
| DPG | 59.5 | 59.5 |
| $C_{14}$ AO | 20 | 20 |
| SLF18 | 20 | 20 |
| Dye | 0.4 | 0.5 |
| Perfume | 0.1 | 0 |

Aldehyde-Comprising Perfume

Tables 2 and 3 exemplify aldehyde-comprising perfume compositions which form part of the hot melt adhesive. Aldehydes are highlighted in bold. Perfume A has a lemon connotation. Perfume B has a fresh lily of the valley connotation.

TABLE 2

| Perfume A | |
|---|---|
| Ingredient | % |
| Orange phase oil | 50 |
| **Hydroxycitronellal** | **10** |
| **Citral** | **5.0** |
| Geraniol | 3.5 |
| Citronellol | 3.0 |
| Linalool | 1.0 |
| Methyl Dihydro Jasmonate | 10 |
| **Ligustral** | **0.75** |
| **Lilial** | **9.0** |
| **Undecyl Aldehyde** | **0.75** |
| **Decyl Aldehyde** | **6.0** |

TABLE 3

| Perfume B | |
|---|---|
| Ingredient | % |
| Benzyl Acetate | 6.0 |
| Citronellol | 12.0 |
| **Hydroxycitronellal** | **15.0** |
| **Citronellal** | **0.5** |
| **Lyral** | **8.0** |
| **Hexyl Cinnamic Aldehyde** | **15.0** |
| **Lilial** | **10.0** |
| Indol | 0.5 |
| **Liminal** | **1.0** |
| Linalool | 10.0 |
| Methyl Dihydro Jasmonate | 10.0 |

TABLE 3-continued

| Perfume B | |
|---|---|
| Ingredient | % |
| Phenyl Ethyl Alcohol | 10.0 |
| **Ligustral** | **2.0** |

Hot Melt Adhesive

Composition A 24.75 parts of Elvax® 250, a poly(ethylene-co-vinyl acetate) with a vinyl acetate content of 28 wt % and a melt flow index of 25 dg/min (ASTM D1238), available from Dupont, 9.75 parts of Escorene Ultra MV 02528, a poly (ethylene-co-vinyl acetate) with a vinyl acetate content of 27.5 wt % and a melt viscosity at 190° C. of 3100 cps (ExxonMobil method), available from ExxonMobil Chemical, 15 parts of Foralyn™ 5020F, a rosin ester plasticiser available from Eastman Chemical and 0.5 parts of Irganox™ B225, an antioxidant available from Ciba Geigy (Switzerland) were added to a sigma blade mixer and heated to a temperature of about 10-20° C. above the melting point of the polymers (about 120° C.). The ingredients were mixed until a homogeneous mass was obtained. The temperature was then reduced to a point where the mixture was still molten, typically to about 10-20° C. above the melting point of the mixture (about 80° C. in the present case). 50 parts of perfume (Composition A or B, Table 2 or 3) was added to the plasticised polymer mixture. The ingredients were mixed until a homogeneous mixture was obtained.

Composition B 39.5 parts of Escorene Ultra MV 02528, a poly(ethylene-co-vinyl acetate) with a vinyl acetate content of 27.5% and a melt viscosity at 190° C. of 3100 cps (ExxonMobil method), available from ExxonMobil Chemical, 30 parts of Foralyn™ 5020F, a rosin ester plasticiser available from Eastman Chemical and 0.5 parts of Irganox™ B225, an antioxidant available from Ciba Geigy (Switzerland) were added to a sigma blade mixer and heated to a temperature of about 10-20° C. above the melting point of the polymer (about 80° C.). The ingredients were mixed until a homogeneous mass was obtained. The temperature was then reduced to a point where the mixture was still molten, typically to about 10-20° C. above the melting point of the mixture (about 60° C. in the present case). 30 parts of perfume (Composition A or B, Table 2 or 3) was added to the plasticised polymer mixture. The ingredients were mixed until a homogeneous mixture was obtained.

0.12 grams of the resulting mixture are delivered to an internal wall of a flexible PET/PE laminate self-standing collapsible bag with press-to-close ziplock, the mixture is cooled to room temperature. 12 pouches are introduced into the bag and the bag is closed. The bag geometry is that shown in FIG. 1 of WO 03/047998, the dimensions are 8.9 cm gusset, 15.9 cm width and 18.1 cm height. The pouch, hot melt and perfume compositions used in each example are shown in Table 4.

TABLE 4

| Example | Pouch composition | Hot melt composition | Perfume composition |
|---|---|---|---|
| 1 | A | A | A |
| 2 | B | A | A |
| 3 | A | A | B |
| 4 | B | A | B |
| 5 | A | B | A |
| 6 | B | B | B |

The bags are opened after 48 hours, a pouch is taken out and the bags are subsequently closed. The process is repeated everyday for 11 days. Every time that the bags are opened a very pleasant smell is perceived.

Examples 1 to 6 are repeated using 0.18 grams of the hot melt adhesive, 20 pouches and bags of the following dimensions: 8.9 cm gusset, 15.9 cm width and 20.1 cm height. Similar results are obtained.

All documents cited in the DETAILED DESCRIPTION OF THE INVENTION are, in relevant part, incorporated herein by reference; the citation of any document is not to be construed as an admission that it is prior art with respect to the present invention While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A method of preventing or reducing malodour in the interior of a packaging container containing a malodour-generating water-soluble pouch comprising a cleaning composition and an enveloping film material, by providing the packaging container with a hot melt adhesive adhered to an internal wall thereof, the hot melt adhesive comprising 20% to 70% by weight of an aldehyde-comprising perfume.

2. A method according to claim 1 wherein the enveloping film material is polyvinyl alcohol.

3. A method according to claim 1 wherein the water-soluble pouch is a dual-compartment pouch having a powder compartment and a liquid compartment.

4. A method according to claim 1 wherein the packaging container further comprises a window for viewing contents of the packaging container.

* * * * *